US010047599B2

(12) United States Patent
Maeland

(10) Patent No.: US 10,047,599 B2
(45) Date of Patent: Aug. 14, 2018

(54) SUBSEA SENSOR HUB

(71) Applicant: Siemens Aktiengesellschaft, Munich (DE)

(72) Inventor: Sigbjoern Maeland, Bremnes (NO)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/545,369

(22) PCT Filed: Nov. 19, 2015

(86) PCT No.: PCT/EP2015/077092

§ 371 (c)(1),
(2) Date: Jul. 21, 2017

(87) PCT Pub. No.: WO2016/119943

PCT Pub. Date: Aug. 4, 2016

(65) Prior Publication Data

US 2018/0010440 A1 Jan. 11, 2018

(30) Foreign Application Priority Data

Jan. 28, 2015 (EP) ..... 15152885

(51) Int. Cl.
*E21B 47/01* (2012.01)
*E21B 47/06* (2012.01)
*E21B 47/00* (2012.01)

(52) U.S. Cl.
CPC ..... *E21B 47/011* (2013.01); *E21B 47/0001* (2013.01); *E21B 47/06* (2013.01)

(58) Field of Classification Search
CPC .... E21B 33/0355; E21B 33/068; E21B 34/02; E21B 47/00; E21B 47/0001; E21B 47/06; E21B 47/011
See application file for complete search history.

(56) References Cited

U.S. PATENT DOCUMENTS 3,016,963 A * 1/1962 Bennett ..... E21B 4/14 175/40
2014/0007668 A1* 1/2014 Shanks ..... E21B 47/06 73/152.51

(Continued)

FOREIGN PATENT DOCUMENTS

DE 10134380 A1 2/2003
WO WO 2012068323 A2 5/2012
WO WO-2015047586 A1 * 4/2015 ..... G01L 19/06

OTHER PUBLICATIONS

"API Specification 6A, Specification for Wellhead and Christmas Tree Equipment; ISO 10423:2009"; pp. 1-40; XP055199734; 20th Edition; Retrieved from Internet: URL:http://www.api.org/-/media/files/certification/nonogram-apiqr/program-updates/6a-20th-edition-purch-guidelines-rl-20120429.pdf, 2010.

(Continued)

*Primary Examiner* — James G Sayre
(74) *Attorney, Agent, or Firm* — Harness, Dickey & Pierce, P.L.C.

(57) ABSTRACT

A subsea sensor hub is for a coupling sensor element to an electrical unit. In an embodiment, he subsea sensor hub includes a first end for receiving a sensor element, a second end for receiving the electrical unit, and at least one through hole extending from the first end to the second end. Furthermore, at least one electrical connecting element is arrangeable to extend through the at least one through hole.

21 Claims, 3 Drawing Sheets

(56) References Cited

U.S. PATENT DOCUMENTS

| | | | | |
|---|---|---|---|---|
| 2014/0055278 | A1* | 2/2014 | Chau | E21B 47/00 340/854.4 |
| 2014/0216757 | A1* | 8/2014 | Kleppa | E21B 33/0355 166/377 |

OTHER PUBLICATIONS

International Search Report PCT/ISA/210 for International Application No. PCT/EP2015/077092 dated Apr. 11, 2016.
Extended European Search Report for Application No. 15152885.8 dated Jul. 13, 2015.
Transmittal of the International Prelimenary Report on Patentability for International Application No. PCT/EP2015/0077092 dated Mar. 3, 2017.

* cited by examiner

SUBSEA SENSOR HUB

PRIORITY STATEMENT

This application is the national phase under 35 U.S.C. § 371 of PCT International Application No. PCT/EP2015/077092 which has an International filing date of Nov. 19, 2015, which designated the United States of America and which claims priority to European patent application number EP15152885.8 filed Jan. 28, 2015, the entire contents of which are hereby incorporated herein by reference.

FIELD

An embodiment of present invention generally relates to a subsea sensor hub of a subsea sensor for coupling a sensor element to an electrical unit in a subsea environment.

BACKGROUND

In subsea applications, for example subsea oil production, there may be a need for sensing pressure or temperature in, for example, hydraulic conduits or vessels. However, sensors used in deep sea environments may be exposed to a very high pressure to be sensed in a range of up to, for example, 1,400 bar (or 20,000 PSI), a temperature in a range of, for example, −40° C. to +205° C., and an environmental pressure of, for example, 350 bar (or 5,000 PSI). Corresponding requirements for such sensors in drilling and production equipment of petroleum and natural gas industries are defined in international standards, for example in NS-EN ISO 10423:2009/API 6A. However, the requirements defined in these standards may be difficult to fulfil.

Therefore, up to now these kinds of sensors have frequently been manufactured and delivered with pressure containing parts that do not fully comply to these standards and a request for concession has been accepted for each project using these sensors. Conventional sensors may thus not achieve the desired protection against the large pressure differences that can prevail between the high process pressure in the hydraulic conduit, pipeline or vessel, and the ambient pressure, which is still relatively high in a subsea environment.

SUMMARY

Therefore, the inventors have discovered that it is desirable to provide a solution for such sensors with less deviations to the barrier requirements defined in the standards, for example in NS-EN ISO 10423:2009/API 6A. The inventors have further discovered that it is desirable to provide a sensor that provides effective and secure separation between the high process pressure and the ambient pressure, in particular the pressure prevailing inside the sensor compartment housing electronic components.

According to at least one embodiment of the present invention, a subsea sensor hub and a subsea sensor are defined in the independent claims. The dependent claims define preferred and advantageous embodiments of the present invention.

According to an embodiment of the present invention, a subsea sensor hub for coupling a sensor element to an electrical unit is provided. The subsea sensor hub comprises a first end for receiving the sensor element and a second end for receiving the electrical unit. At least one through hole is extending from the first end to the second end through the subsea sensor hub. At least one electrical connecting element is arrangeable or arranged to extend through the at least one through hole for providing an electrical connection between the sensor element and the electrical unit.

According to an embodiment of the invention, a subsea sensor hub assembly is provided which comprises a subsea sensor hub according to any outlined embodiment of the present invention and/or configuration. It further comprises a hub support for mounting the subsea sensor hub to a process fluid carrying component, such as a conduit, a pipe or a vessel, the hub support comprising a recess into which the subsea sensor hub can be inserted as an inset, and a flange for mounting the hub support to the process fluid carrying component. The hub support is configured such that when it is mounted to the process fluid carrying component by means of the mounting flange, the subsea sensor hub is pressed against the process fluid carrying component.

According to an embodiment of the present invention, a subsea sensor is provided which comprises the above described subsea sensor hub, a sensor element, and an electrical unit. The sensor element is arranged at the first end of the subsea sensor hub and coupled to the at least one electrical connecting element at the first end. The sensor element may comprise, for example, a pressure sensor element or a temperature sensor element or a combination of these sensor elements. The electrical unit is arranged at the second end of the subsea sensor hub and coupled to the at least one electrical connecting element at the second end. The electrical unit may be configured to process signals from the sensor element, for example by filtering and amplifying a signal from the sensor element, and to output the processed signals via an electrical connector or an electrical wire. By using the above-described subsea sensor hub for coupling the sensor element to the electrical unit, the sensor element may be arranged in a high pressure or high temperature environment, for example in a conduit, pipe, vessel or tube of an hydraulic installation of a subsea system, for example a so-called Christmas tree, whereas the electrical unit is shielded from the high pressure and high temperatures, but electrically connected to the sensor element via the at least one electrical connecting element.

Although specific features are described in the above summary and the following detailed description in connection with specific embodiments and aspects, it is to be understood that the features of the embodiments and aspects may be combined with each other unless specifically noted otherwise.

Although specific features are described in the above summary and the following detailed description in connection with specific embodiments and aspects, it is to be understood that the features of the embodiments and aspects may be combined with each other unless specifically noted otherwise.

BRIEF DESCRIPTION OF THE DRAWINGS

The present invention will now be described in more detail with reference to the accompanying drawings.

DETAILED DESCRIPTION OF THE EXAMPLE EMBODIMENTS

Figure 1:
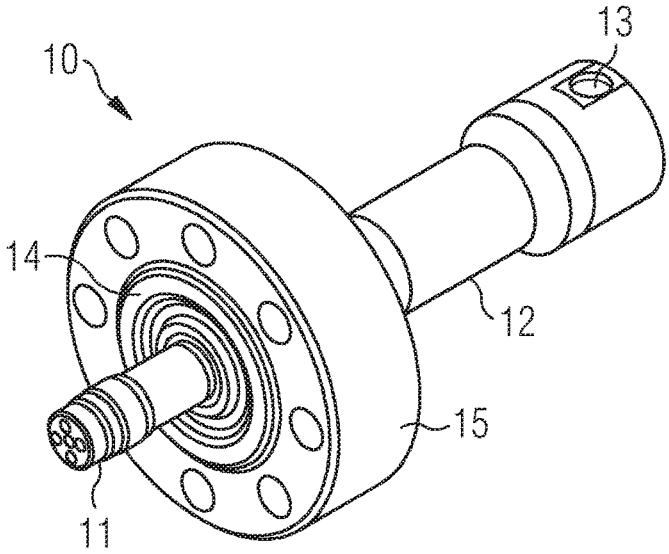
FIG. 1 shows schematically a perspective view of a subsea sensor according to an embodiment of the present invention.

According to an embodiment of the present invention, a subsea sensor hub for coupling a sensor element to an electrical unit is provided. The subsea sensor hub comprises a first end for receiving the sensor element and a second end for receiving the electrical unit. At least one through hole is extending from the first end to the second end through the subsea sensor hub. At least one electrical connecting element (22) is arrangeable or arranged to extend through the at least one through hole (21) for providing an electrical connection between the sensor element and the electrical unit.

Such subsea sensor hub may provide a reliable and effective pressure barrier between the sensor element and the electrical unit.

In an embodiment, the first end (or side) of the sensor hub at which the sensor element is received, the sensor hub is mountable to a process fluid carrying component (in particular a conduit, pipe or vessel) such that the first end of the sensor hub is at least partially exposed to a process pressure prevailing inside the process fluid carrying component.

At the second end, of the sensor hub at which the electrical unit is received, the sensor hub may be mountable to a housing of the electrical unit such that the second end of the sensor hub is exposed to a pressure prevailing inside the housing of the electrical unit, for example the ambient pressure prevailing in the subsea environment (pressure compensated housing) or a predetermined pressure (pressure resistant housing; e.g. close to atmospheric pressure).

Accordingly, such sensor hub may provide a secure separation and barrier between the process pressure and the ambient or predetermined pressure. In particular, the at least one through hole may provide the only connection(s) in the sensor hub between the environment in which the process pressure prevails and the second end of the hub where the electrical unit is to be received.

In an embodiment, at least one electrical connecting element, for example an electrically conducting wire or an electrically conducting pin, is arrangeable or arranged within the through hole to extend from the first end to the second end through the at least one through hole.

In an embodiment, the subsea sensor hub comprises or consists of a main body (or inset), which comprises the first end, the second end and the at least one through hole, the main body being formed as a one-piece element. The main body or inset may in particular be formed of a single piece of material. The main body or inset of the subsea sensor hub may in particular not comprise any welds or screw connections. By forming the main body of the subsea sensor hub as a single or integral part, connections like, for example, pressure welds can be avoided and an increased reliability may be achieved, thus meeting higher standards with respect to pressure integrity.

In an embodiment, the subsea sensor hub comprises at the first end a recess for receiving the sensor element, wherein the at least one through hole is arranged at the bottom of the recess.

In an embodiment, the subsea sensor hub extends in an axial direction from the first end to the second end, the subsea sensor hub having at its outer perimeter a projection in radial direction that forms a support shoulder. By means of such support shoulder, the subsea sensor hub can be mounted to and pressed against a process fluid carrying component (e.g. a conduit, pipe or vessel), for example by means of a hub support or flange.

The subsea sensor hub may be adapted to be mounted to a process fluid carrying component by being pressed against the conduit, pipe or vessel, respectively, using a hub support or flange. In particular, the subsea sensor hub itself may not comprise any through holes for providing an attachment of the subsea sensor hub to the process fluid carrying component which bears the main load applied by the process pressure. By providing such configuration, the subsea sensor hub, in particular the main body or inset can be made of a relatively soft metal material having corrosion resistant properties.

The subsea sensor hub may at its first end have an end face, in particular an annular end face around the above-mentioned recess. The end face may have a sealing portion, in particular a circumferential recess, for receiving a sealing element for sealing the subsea sensor hub to a process fluid carrying component, such as a conduit, pipe or vessel. The sealing element may be an O-ring seal, in particular a metal-gasket or an elastomeric gasket. The end face may comprise two or more of such sealing portions for providing a double barrier seal.

In an embodiment, the subsea sensor hub has at its second end a mounting portion and a sealing portion for a housing of the electrical unit. A housing of the electrical unit may thus be mounted and sealed to the subsea sensor hub.

In an embodiment, at least one electrical connecting element is arranged within the through hole such that it is extending from the first end to the second end through the at least one through hole, and the subsea sensor hub comprises furthermore glass material which supports the at least one electrical connecting element within the at least one through hole. The glass-to-metal electrical feedthrough provided by the glass material supporting the electrical connecting element, provides a reliable sealing and feedthrough which can withstand high pressures and temperatures from the process. The sensor hub may thus be provided for coupling a sensor element to an electrical unit.

According to an embodiment, the glass material is casted as cast glass into the at least one through hole. By casting the glass material directly into the through hole, a manufacturing process may be simplified and the electrical connecting elements may be individually encapsulated in one or a plurality of through holes.

According to another embodiment, the glass material is arranged within the through hole such that it provides a sealing between the first and the second end of the subsea sensor hub. For example, the glass material and a material of the subsea sensor hub, for example a metallic material, may have compatible coefficients of expansion. In other words, a coefficient of expansion of the glass material may have a value which corresponds to or is close to a coefficient of expansion of the material of the subsea sensor hub. Thus, a tight connection between the glass material, the electrical connecting elements and the through hole may be provided over a wide temperature range.

According to another embodiment, the at least one electrical connecting element has a cylindrical shape or conical/tapered shape. The electrical connecting element is extending in an axial direction from the first end to the second end through the at least one through hole. In other words, a longitudinal direction of the electrical connecting element is extending from the first end to the second end of the subsea sensor hub. The glass material surrounds a lateral surface of the at least one electrical connecting element. Thus, the glass material acts like a coating arranged at the lateral convex surface of the cylindrical or conical electrical connecting element. The cylindrical or conical shape may have the form of a connector pin or a connecting wire for coupling the sensor element at the first end to the electrical unit at the second end. By coating the electrical connecting element with the glass material, a reliable electrical isolation as well as a high pressure and high temperature resistive sealing may be provided.

The subsea sensor hub may be made of metal material, in particular a corrosion resistant metal. It may for example be made of an alloy like alloy 625, in particular Inconel 625. Thus, the subsea sensor hub may be resistive against mechanical impacts and chemical influences from the well.

The glass material may be in direct contact with the metal material of the subsea sensor hub and the at least one electrical connecting element. The metal material of the subsea sensor hub, the material of the at least one electrical connecting element and the glass material may have compatible coefficients of expansion such that a reliable sealing between the first end and the second end may be provided over a wide temperature range of, for example −40° C. to +200° C.

According to another embodiment, the subsea sensor hub comprises a plurality of through holes, wherein the above-mentioned at least one through hole is part of the plurality of through holes. Furthermore, the subsea sensor hub comprises a plurality of electrical connecting elements, wherein the above-mentioned at least one electrical connecting element belongs to the plurality of electrical connecting elements. Each of the plurality of through holes extends from the first end to the second end. Furthermore, each of the electrical connecting elements is associated with a corresponding one of the plurality of through holes. Additionally, each of the electrical connecting elements extends from the first end to the second end within the corresponding one of the plurality of through holes. For example, in each through hole only one electrical connecting element is extending. However, two or more electrical connecting elements may be arranged within one through hole. The electrical connecting elements may be arranged within the corresponding through hole such that the electrical connecting elements are arranged apart from each other and apart from an internal surface of the through hole. Thus, a reliable isolation between the electrical connecting elements and the housing of the subsea sensor hub may be provided.

According to an embodiment of the invention, a subsea sensor hub assembly is provided which comprises a subsea sensor hub according to any of the above/below outlined embodiments and configurations. It further comprises a hub support for mounting the subsea sensor hub to a process fluid carrying component, such as a conduit, a pipe or a vessel, the hub support comprising a recess into which the subsea sensor hub can be inserted as an inset, and a flange for mounting the hub support to the process fluid carrying component. The hub support is configured such that when it is mounted to the process fluid carrying component by means of the mounting flange, the subsea sensor hub is pressed against the process fluid carrying component.

The flange of the hub support may for example have through holes, and bolts, screws or the like may be used to mount the hub support to a corresponding flange of the process fluid carrying component. Accordingly, the subsea sensor hub, in particular its main body, may be made of a softer metal material, such as Inconel 625, that may not be capable of withstanding the high pressure differences that may be present in certain applications. The hub support may be made of a harder material that is capable of taking relatively large differential pressures.

The hub support may for example be made of a metal, in particular of carbon steel. Accordingly, a corrosion resistant mount (via the sensor hub) for the sensor element that can be exposed to the process fluid can be provided, while at the same time, a secure mount (via the hub support) to the process fluid carrying component can be achieved that is capable of withstanding high pressure differences between the process fluid and the ambient medium. Making the subsea sensor hub of a corrosion resistant material may have the particular advantage that the sealing between the process fluid carrying component and the subsea sensor hub may not degrade substantially over time. Thus, the sensor hub and hub support may be two separate parts interacting in the subsea sensor hub assembly.

According to an embodiment of the present invention, a subsea sensor is provided which comprises the above described subsea sensor hub, a sensor element, and an electrical unit. The sensor element is arranged at the first end of the subsea sensor hub and coupled to the at least one electrical connecting element at the first end. The sensor element may comprise, for example, a pressure sensor element or a temperature sensor element or a combination of these sensor elements. The electrical unit is arranged at the second end of the subsea sensor hub and coupled to the at least one electrical connecting element at the second end. The electrical unit may be configured to process signals from the sensor element, for example by filtering and amplifying a signal from the sensor element, and to output the processed signals via an electrical connector or an electrical wire. By using the above-described subsea sensor hub for coupling the sensor element to the electrical unit, the sensor element may be arranged in a high pressure or high temperature environment, for example in a conduit, pipe, vessel or tube of an hydraulic installation of a subsea system, for example a so-called Christmas tree, whereas the electrical unit is shielded from the high pressure and high temperatures, but electrically connected to the sensor element via the at least one electrical connecting element.

The subsea sensor may further comprise a housing of the electrical unit that is mounted and sealed to the subsea sensor hub. It may further comprise a hub support for mounting the hub to a conduit, pipe or vessel in which process fluid is present.

In the following, example embodiments of the invention will be described in more detail.

It is to be understood that the features of the various example embodiments described herein may be combined with each other unless specifically noted otherwise. Same reference signs in the various drawings refer to similar or identical components.

FIG. 1 shows schematically a perspective view of a subsea sensor 10 which may be used as a sensor for determining a temperature or a pressure in a subsea equipment, for example in a process fluid carrying component such as a vessel or a pipe or a conduit of a so-called Christmas tree of a hydraulic subsea system.

The subsea sensor 10 comprises a sensor element 11 which may be in a direct contact with a pressurized fluid, in particular a process fluid, such as pressurized oil, for measuring a temperature and/or a pressure of the fluid. The process fluid may comprise oil, gas, water and solids, e.g.

mud/sand/debris, or a mixture thereof. It may have a relatively high pressure and temperature since it may be produced from a subsea well.

The subsea sensor 10 comprises furthermore an electrical unit 12 which is electrically coupled to the sensor element 11 and may provide a pre-processing of electrical signals from the sensor element like, for example, an amplification or a filtering. The electrical unit 12 may provide the processed electrical signals from the sensor element 11 at an output 13 to which a connector or an electrical line is coupled. Typically, the electrical unit 12 is arranged outside the process fluid carrying component in which the sensor element 11 is arranged. In the present embodiment, the sensor element 11 and the electrical unit 12 are coupled by a subsea sensor hub 14 which provides an electrical and mechanical coupling of the sensor element 11 to the electrical unit 12 as well as a sealing to prohibit a fluid discharge from the inside of the process fluid carrying component to an outside through the subsea sensor 10. In particular, the subsea sensor hub provides a pressure barrier. Furthermore, a hub support 15 comprising a flange, may be provided for fixing the subsea sensor 10 to the vessel or conduit.

In the following, the side of the subsea sensor 10 where the sensor element 11 is arranged, will be called front side of the subsea sensor 10 and the opposite side of the subsea sensor where the electrical output 13 is arranged will be called rear side of the subsea sensor 10.

Figure 2:
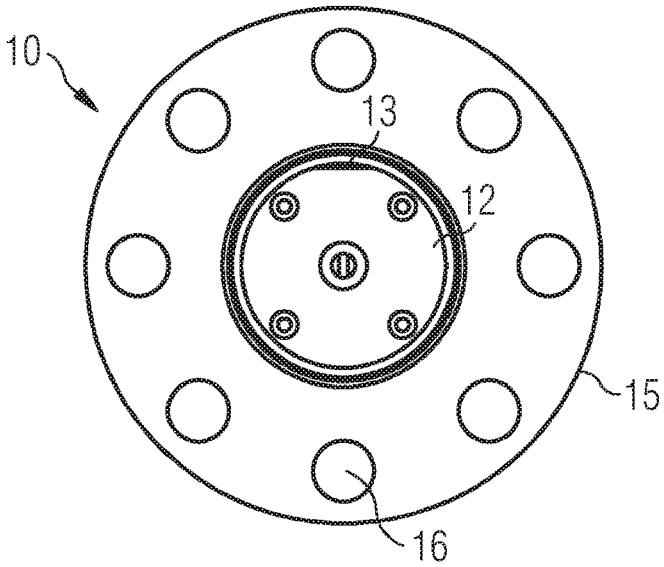
FIG. 2 shows schematically the subsea sensor of FIG. 1 in a rear view.

FIG. 2 shows a rear side view of the subsea sensor 10 in which the electrical unit 12 and the electrical output 13 are indicated. Furthermore, the hub support 15 is shown which comprises or flange with through holes 16 (e.g. eight through-holes) for fixing the subsea sensor 10 to a process fluid carrying component (fluid vessel, conduit or pipe, for example), by means of stud bolts or screws extending through the through holes 16.

Figure 3:
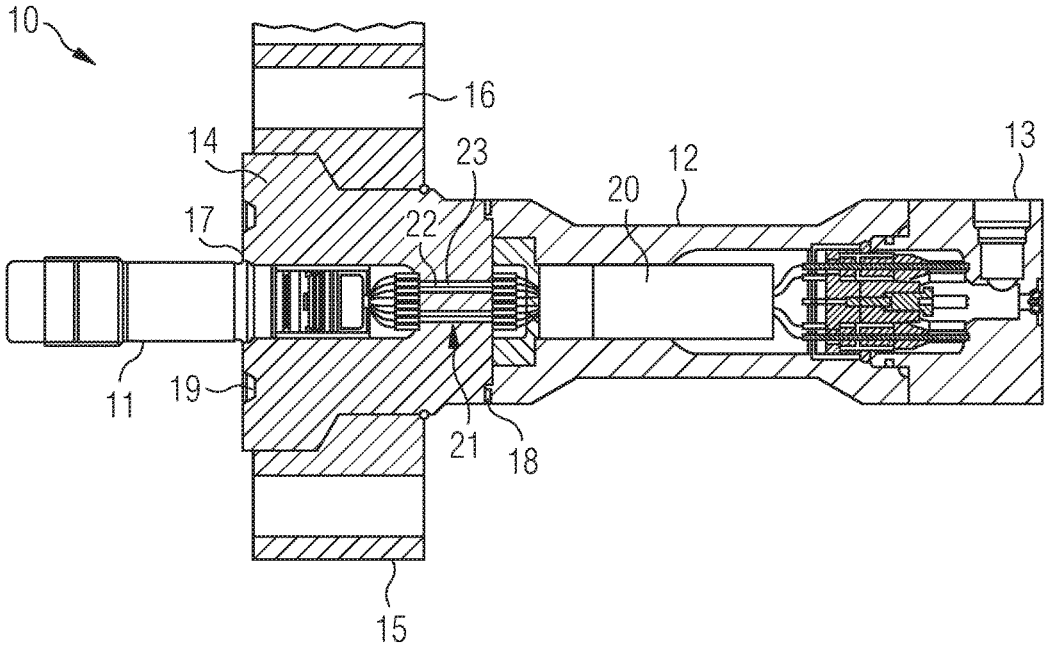
FIG. 3 shows schematically the subsea sensor of FIG. 1 in a sectional view.

FIG. 3 shows a sectional side view of the subsea sensor 10 of FIG. 1. The subsea sensor hub 14 has at the front side a first end 17 for receiving the sensor element 11. At the rear end side the subsea sensor hub 14 has a second end 18 which is coupled to a housing of the electrical unit 12. At the first end 17 of the subsea sensor hub 14, a ring groove 19 may be provided for receiving a seal, in particular a metal gasket, for sealing the first end 17 of the subsea sensor hub 14 at a surface of a fluid vessel or conduit.

Inside of the electrical unit 12, electronic circuits 20 may be provided which receive electrical signals from the sensor element 11 via electrical connecting elements 22 for processing these electrical signals and outputting them at the electrical output 13. The electrical connecting elements 22 may comprise electrical wires or pins which are extending through one or more through holes 21 extending from the first end 17 to the second end 18 within the subsea sensor hub 14. The electrical connecting elements 22 are each surrounded by glass material 23 which isolates the electrical connecting elements 22 against each other and against the subsea sensor hub 14. Furthermore, the glass material 23 seals the through holes 21 such that a fluid communication between the first end 17 and the second end 18 through the through holes 21 is prevented.

Figure 4:
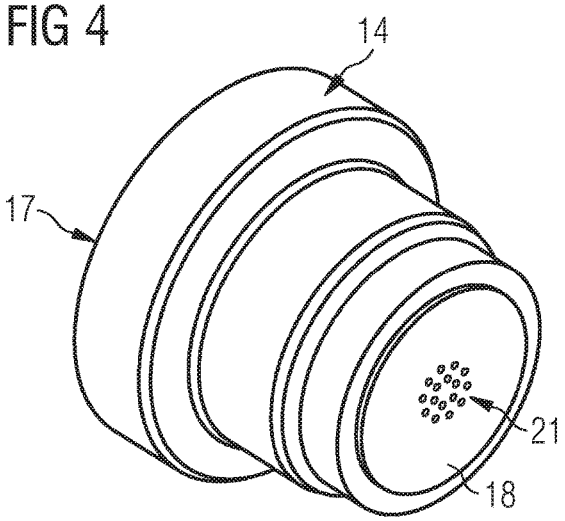
FIG. 4 shows schematically a perspective view of a subsea sensor hub according to an embodiment of the present invention.

FIG. 4 shows the subsea sensor hub 14 in isolation (i.e. the single piece main body of the subsea sensor hub). At the first end 17, the sensor element 11 of FIGS. 1-3 may be received, and to the second end 18, the electrical unit 12 of FIGS. 1-3 may be coupled. The subsea sensor hub 14 comprises a plurality of through holes 21 which are extending in a longitudinal (axial) direction of the subsea sensor hub 14 from the first end 17 to the second end 18.

Figure 5:
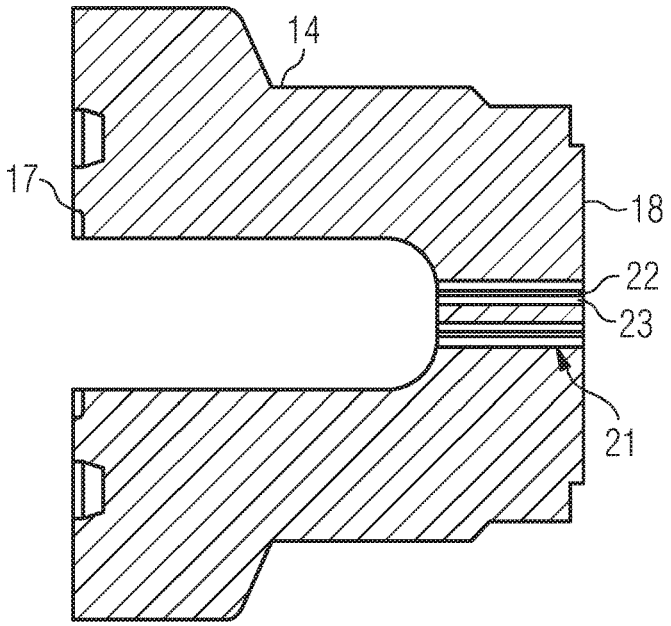
FIG. 5 shows schematically a sectional view of the subsea sensor hub of FIG. 4.

FIG. 5 shows a sectional side view of the subsea sensor hub 14 (i.e. the single piece main body of the subsea sensor hub) indicating the position and direction of the through holes 21. As can be seen, the subsea sensor hub has at the first end 17 a recess for receiving the sensor element. The through holes 21 extend from the bottom of the recess towards the second end 18 of the subsea sensor hub. At the first end 17, the subsea sensor hub has an end face, in particular an annular end face around the recess. A sealing portion in form of a groove for receiving the above-mentioned seal is illustrated. At its outer periphery, the subsea sensor hub has a protrusion extending in radial direction, which forms a sloped shoulder facing towards the second end 18. By means of the hub support 15, mounting pressure can be applied to the shoulder of subsea sensor hub 14 for pressing and sealing the subsea sensor hub 14 against the process fluid carrying component. As shown in FIG. 3, the subsea sensor hub 14 may form an (single piece) inset in the hub support; it may protrude slightly from the hub support at its first end 17 so that the hub support can apply a significant mounting pressure to the subsea sensor hub so as to be capable of withstanding the high pressure differences between the process fluid and the subsea environment.

At the second end 18, a mounting portion and a sealing portion can be provided for mounting and sealing a housing of the electrical unit 12 to the subsea sensor hub 14, as illustrated in FIG. 3.

Figure 6:
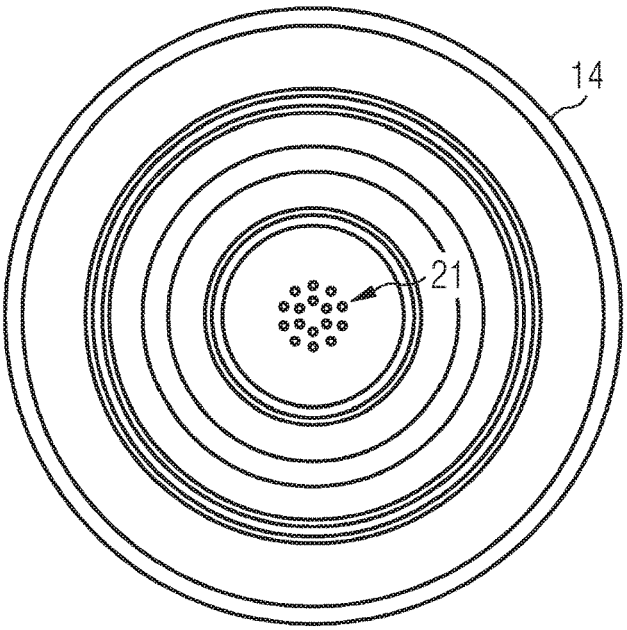
FIG. 6 shows schematically a front view of the subsea sensor hub of FIG. 4.

FIG. 6 shows a planar view on the first end 17 of the subsea sensor hub 14. As can be seen from FIG. 6, the subsea sensor hub 14 comprises, for example, sixteen through holes 21. However, the number of through holes 21 shown in FIGS. 4-6 is only an example and the subsea sensor hub 14 may comprise any other suitable number of through holes including, for example, only one through hole.

Within each through hole 21 one or more electrical connecting elements 22 may be arranged and surrounded by glass material 23. For example, each electrical connecting element 22 may have a cylindrical or conical shape and an axial direction of the cylindrical or conical shape may be extending from the first end 17 to the second end 18 through the corresponding through hole 21. In other embodiments, the through-holes may have a conical shape. The conical shape may be tapered towards the second end 18 of the subsea sensor hub 14. The electrical connecting elements 22 may have a cylindrical shape or a corresponding conical/tapered shape.

With such conical shape of the through hole, the pressure difference across the through-holes will press the electrical connecting elements 22 and/or the glass material against the inner walls of the through-holes, thus improving the sealing and reducing the risk of leakage through the through-holes. In other embodiments, where the pressure at the second end 18 is higher as at the first end 17, the conical shapes of the through hole 21 and/or electrical connecting element 22 may be tapered towards the first end 17.

The glass material 23 surrounds a lateral surface of each electrical connecting element 22 and is in direct contact with the material of the main body (or inset) of the subsea sensor hub 14. The main body of the subsea sensor hub 14 may be made, for example, of metal material, for example alloy 625, in particular Inconel 625. As shown in FIGS. 4-6, the main body or inset of the subsea sensor hub 14 is a one-piece element which may reduce the risk of breakage or leakage. Therefore, the one-piece subsea sensor hub 14 with glass-to-metal electrical feedthrough provides an improved pressure barrier and the first end 17 of the subsea sensor hub 14 may be exposed to high pressure environments, for example up to 20 KPSI, and to a wide temperature range of, for example, −40° C. to +205° C.

Furthermore, the subsea sensor hub ensures that the pressure barrier does not extend into the housing of the electrical unit 12. Rather, by means of the subsea sensor hub, a pressure barrier is provided which contains the high pressure of the process fluid to the front part of the subsea sensor where only the sensor element is disposed.

The invention claimed is:

1. A subsea sensor hub assembly comprising:

a subsea sensor hub to provide a pressure barrier between a sensor element and an electrical unit, the subsea sensor hub including:

a first end to receive the sensor element, a second end to receive the electrical unit, at least one through hole extending from the first end to the second end, wherein at least one electrical connecting element is arrangeable to extend through the at least one through hole to provide an electrical connection between the sensor element and the electrical unit, the subsea sensor hub being configured to extend in an axial direction from the first end to the second end and including, at an outer perimeter of the subsea hub, a projection in a radial direction configured to form a support shoulder to allow a mounting pressure to be applied to the subsea sensor hub for mounting the subsea sensor hub to a process fluid carrying component; and a hub support to mount the subsea sensor hub to the process fluid carrying component, the hub support including a recess into which the subsea sensor hub is insertable as an inset, and a flange to mount to the process fluid carrying component, wherein the hub support is configured such that, when mounted to the process fluid carrying component via the mounting flange, the support shoulder of the subsea sensor hub is configured to be pressed against the process fluid carrying component, and wherein the hub support is made of a first metal or alloy and the subsea sensor hub is made of a second metal or alloy, different from the first metal or alloy.

2. The sensor hub assembly of claim 1, wherein at the first end of the sensor hub, the sensor hub is mountable to a process fluid carrying component such that the first end of the sensor hub is at least partially exposed to a process pressure prevailing inside the process fluid carrying component.

3. The subsea sensor hub assembly of claim 2, wherein the subsea sensor hub comprises a main body comprising the first end, the second end and the at least one through hole, the main body being formed as a one-piece element.

4. The sensor hub assembly of claim 2, wherein at least one electrical connecting element is arranged within the through hole such that the at least one electrical connecting element is extending from the first end to the second end through the at least one through hole, the subsea sensor hub further comprising glass material to support the at least one electrical connecting element within the at least one through hole.

5. The subsea sensor hub assembly of claim 4, wherein the glass material comprises cast glass casted into the at least one through hole.

6. The subsea sensor hub assembly of claim 1, wherein the subsea sensor hub comprises a main body comprising the first end, the second end and the at least one through hole, the main body being formed as a one-piece element.

7. The sensor hub assembly of claim 1, wherein the at least one through-hole has a cylindrical shape.

8. The sensor hub assembly of claim 1, wherein the at least one through-hole has a conical shape.

9. The sensor hub assembly of claim 8, wherein the conical shape of the at least one through-hole is tapered towards the second end of the sensor hub.

10. The sensor hub assembly of claim 1, wherein at least one electrical connecting element is arranged within the through hole such that the at least one electrical connecting element extends from the first end to the second end through the at least one through hole, the subsea sensor hub further comprising glass material to support the at least one electrical connecting element within the at least one through hole.

11. The subsea sensor hub assembly of claim 10, wherein the glass material comprises cast glass casted into the at least one through hole.

12. The subsea sensor hub assembly of claim 11, wherein the glass material is arranged within the through hole such that the glass material provides a sealing between the first end and the second end.

13. The subsea sensor hub assembly of claim 10, wherein the glass material is arranged within the through hole such that the glass material provides a sealing between the first end and the second end.

14. The subsea sensor hub assembly of claim 10, wherein the at least one electrical connecting element has a cylindrical or conical shape, wherein the electrical connecting element extends in an axial direction from the first end to the second end through the at least one through hole, and wherein the glass material surrounds a lateral surface of the at least one electrical connecting element.

15. The subsea sensor hub assembly of claim 10, wherein the subsea sensor hub is made of metal material, and wherein the glass material is in direct contact with the metal material of the subsea sensor hub and the at least one electrical connecting element.

16. The subsea sensor hub assembly of claim 1, wherein the subsea sensor hub comprises a plurality of through holes comprising the at least one through hole and a plurality of electrical connecting elements comprising the at least one electrical connecting element, wherein each of the plurality of through holes extends from the first end to the second end, and wherein each of the electrical connecting elements is associated with a corresponding one of the plurality of through holes and extends from the first end to the second end within a corresponding one of the plurality of through holes.

17. The subsea sensor hub assembly of claim 1, wherein the subsea sensor hub comprises a plurality of electrical connecting elements comprising the at least one electrical connecting element, and wherein the plurality of electrical connecting elements is arranged within one of the at least one through hole.

18. A subsea sensor comprising:

the subsea sensor hub assembly of claim 1, wherein at least one electrical connecting element is arranged within the through hole such that the at least one electrical connecting element extends from the first end to the second end through the at least one through hole;

a sensor element arranged at the first end of the subsea sensor hub, the sensor element being coupled to the at least one electrical connecting element at the first end; and an electrical unit arranged at the second end of the subsea sensor hub, the electrical unit being coupled to the at least one electrical connecting element at the second end.

19. The subsea sensor of claim 18, wherein the sensor element comprises at least one of a pressure sensor element and a temperature sensor element.

20. The subsea sensor hub assembly of claim 1, wherein the hub support is made of carbon steel.

21. The subsea sensor hub assembly of claim 1, wherein the subsea sensor hub consists of a main body comprising the first end, the second end and the at least one through hole, the main body being formed as a one-piece element.

* * * * *